US010403429B2

(12) United States Patent
Peck, Jr.

(10) Patent No.: US 10,403,429 B2
(45) Date of Patent: Sep. 3, 2019

(54) MULTI-PULSE ELECTROMAGNETIC DEVICE INCLUDING A LINEAR MAGNETIC CORE CONFIGURATION

(71) Applicant: The Boeing Company, Chicago, IL (US)

(72) Inventor: James L. Peck, Jr., Huntington Beach, CA (US)

(73) Assignee: The Boeing Company, Chicago, IL (US)

( * ) Notice: Subject to any disclaimer, the term of this patent is extended or adjusted under 35 U.S.C. 154(b) by 222 days.

(21) Appl. No.: 14/994,982

(22) Filed: Jan. 13, 2016

(65) Prior Publication Data

US 2017/0200553 A1 Jul. 13, 2017

(51) Int. Cl.

| | |
|---|---|
| ***H01F 27/28*** | (2006.01) |
| ***H01F 27/24*** | (2006.01) |
| ***H01F 27/245*** | (2006.01) |
| ***H01F 41/02*** | (2006.01) |

(Continued)

(52) U.S. Cl.

CPC ..... *H01F 27/2823* (2013.01); *H01F 27/245* (2013.01); *H01F 30/04* (2013.01); *H01F 30/06* (2013.01); *H01F 41/02* (2013.01)

(58) Field of Classification Search

CPC ..... H01F 27/2823; H01F 27/245

See application file for complete search history.

(56) References Cited

U.S. PATENT DOCUMENTS 352,105 A * 11/1886 Zipernowsky et al. ..... H01F 27/292 336/83

2,215,521 A * 9/1940 Finch ..... H01J 1/135 315/140

2,411,374 A 11/1946 Horstman (Continued)

FOREIGN PATENT DOCUMENTS

CN 2528090 Y 12/2002

CN 1444237 A 9/2003

(Continued)

OTHER PUBLICATIONS

Chinese Patent Office; Office Action for Chinese Patent Application No. 201310299638.5 dated May 27, 2016, 37 Pages.

(Continued)

*Primary Examiner* — Elvin G Enad

*Assistant Examiner* — Malcolm Barnes

(74) *Attorney, Agent, or Firm* — Sage Patent Group

(57) ABSTRACT

An electromagnetic device may include an elongated core in which a magnetic flux in generable. The electromagnetic device may also include a first channel formed through the elongated core and a second channel formed through the elongated core. An inner core member is provided between the first channel and the second channel. The electromagnetic device may also include a primary winding wound around the inner core member and a plurality of secondary windings wound around the inner core member. An electric current flowing through the primary winding generates a magnetic field about the primary winding and the magnetic field is absorbed by the elongated core to generate the magnetic flux in the elongated core. The magnetic flux flowing in the elongated core causes an electric current to flow in each of the plurality of secondary windings.

19 Claims, 8 Drawing Sheets

(51) Int. Cl.
*H01F 30/04* (2006.01)
*H01F 30/06* (2006.01)

(56) References Cited

U.S. PATENT DOCUMENTS 2,569,675 A 10/1951 Keefe
2,780,771 A 2/1957 Lee
3,042,849 A 7/1962 Dortort
3,411,121 A 11/1968 Twomey
3,451,130 A 6/1969 Ellis
3,464,002 A 8/1969 Hentschel
3,602,859 A * 8/1971 Dao ..... H01F 27/245 336/178
4,020,440 A 4/1977 Moerman
4,081,777 A * 3/1978 Cronk ..... H01F 27/245 336/165
4,338,657 A 7/1982 Lisin et al.
4,520,335 A 5/1985 Rauch et al.
4,520,556 A 6/1985 Pasko et al.
4,565,746 A 1/1986 Hayase
4,577,175 A * 3/1986 Burgher ..... H01F 27/10 336/183
4,616,205 A 10/1986 Praught et al.
4,668,931 A 5/1987 Boenitz
4,684,882 A 8/1987 Blain
4,897,626 A 1/1990 Fitter et al.
4,972,353 A 11/1990 Kennedy et al.
5,351,017 A 9/1994 Yano et al.
5,486,756 A * 1/1996 Kawakami ..... G01R 15/185 324/117 R
5,534,831 A 7/1996 Yabuki et al.
5,534,837 A 7/1996 Brandt
5,557,249 A * 9/1996 Reynal ..... H01F 30/12 336/10
5,668,707 A 9/1997 Barrett
5,737,203 A 4/1998 Barrett et al.
5,999,078 A * 12/1999 Herbert ..... H01F 17/06 336/172
6,144,282 A * 11/2000 Lee ..... H01F 27/085 336/217
6,181,079 B1 1/2001 Chang et al.
6,715,198 B2 4/2004 Kawakami
6,972,657 B1 12/2005 Pacala et al.
6,995,646 B1 2/2006 Fromm et al.
7,015,691 B2 3/2006 Kang et al.
7,023,313 B2 4/2006 Sutardja
7,023,317 B1 4/2006 Herbert
7,071,807 B1 7/2006 Herbert
7,106,047 B2 9/2006 Taniguchi
7,148,675 B2 12/2006 Itoh
7,280,025 B2 10/2007 Sano
7,307,502 B2 12/2007 Sutardja
7,342,477 B2 3/2008 Brandt et al.
7,362,206 B1 * 4/2008 Herbert ..... H01F 29/02 336/220
7,378,828 B2 5/2008 Brandt
7,407,596 B2 8/2008 Choi et al.
7,639,520 B1 12/2009 Zansky et al.
8,497,677 B2 7/2013 Miyahara
8,582,255 B2 11/2013 Xin et al.
8,980,053 B2 3/2015 Krahn et al.
9,106,125 B1 8/2015 Brandt et al.
9,159,487 B2 10/2015 Peck
2001/0052837 A1 * 12/2001 Walsh ..... H01F 17/0006 336/174
2002/0075119 A1 * 6/2002 Herbert ..... H01F 27/2847 336/212
2002/0163330 A1 11/2002 Sekiya
2003/0080845 A1 5/2003 Fontanella et al.
2003/0117251 A1 6/2003 Haugs et al.
2004/0027121 A1 2/2004 Choi et al.
2004/0051617 A1 3/2004 Buswell
2004/0124958 A1 7/2004 Watts et al.
2004/0135661 A1 7/2004 Haugs et al.
2005/0035761 A1 2/2005 Park et al.
2005/0093669 A1 5/2005 Ahn et al.
2006/0082430 A1 4/2006 Sutardja
2006/0089022 A1 4/2006 Sano
2006/0197480 A1 9/2006 Mori et al.
2007/0171019 A1 7/2007 Sutardja
2008/0143465 A1 * 6/2008 Tan ..... H01B 3/18 336/5
2008/0150664 A1 * 6/2008 Blankenship ..... H05H 1/36 336/175
2008/0163475 A1 7/2008 Snyder
2009/0128274 A1 5/2009 Park et al.
2009/0244937 A1 10/2009 Liu
2009/0289754 A1 11/2009 Shpiro et al.
2010/0134044 A1 6/2010 Sin
2010/0134058 A1 6/2010 Nagashima et al.
2010/0164673 A1 7/2010 Shim
2010/0194373 A1 * 8/2010 Hamberger ..... H01F 27/34 323/356
2011/0095858 A1 4/2011 Spurny
2011/0163834 A1 7/2011 Stahmann et al.
2011/0210722 A1 9/2011 Paci et al.
2011/0279100 A1 11/2011 Ikriannikov
2011/0279212 A1 11/2011 Ikriannikov et al.
2012/0150679 A1 6/2012 Lazaris
2012/0225784 A1 * 9/2012 Piascik ..... H01F 27/2823 505/150
2012/0226386 A1 9/2012 Kulathu et al.
2012/0315792 A1 12/2012 Costello
2013/0043725 A1 2/2013 Birkelund
2013/0049751 A1 2/2013 Hamberger et al.
2013/0082814 A1 4/2013 Markowski et al.
2013/0255899 A1 * 10/2013 Krahn ..... H01B 3/52 162/157.3
2013/0328165 A1 * 12/2013 Harburg ..... H01L 28/10 257/531
2014/0022040 A1 * 1/2014 Peck ..... H01F 27/2823 336/175
2014/0210585 A1 * 7/2014 Peck, Jr. ..... H01F 27/2823 336/175
2014/0232384 A1 * 8/2014 Peck, Jr. ..... H01F 3/10 324/244
2014/0347153 A1 * 11/2014 Moon ..... H01F 27/38 336/105
2015/0043119 A1 2/2015 Peck, Jr.
2016/0189847 A1 6/2016 Willis
2017/0047155 A1 2/2017 Yao et al.
2017/0053728 A1 * 2/2017 Mehrotra ..... H01F 27/245
2017/0330681 A1 * 11/2017 Kitagawa ..... H01F 27/36

FOREIGN PATENT DOCUMENTS

CN 1495435 A 5/2004
CN 1514258 A 7/2004
CN 1577647 A 2/2005
CN 1615462 A 5/2005
CN 1637969 A 7/2005
CN 1763872 A 4/2006
CN 101995507 A 3/2011
CN 202839278 U 3/2013
DE 2926423 A1 1/1981
DE 4129265 A1 3/1993
EP 1345036 A2 9/2003
EP 2688076 A2 1/2014
JP 59119810 A 7/1984
JP 01242333 A 9/1989
JP 02096797 A 4/1990
JP 02192705 A 7/1990
JP 06260869 A 9/1994
JP 09-077452 A 3/1997
JP 2001167933 A 6/2001
JP 2005116666 A 4/2005
JP 2010127889 A 6/2010
JP 2011238653 A 11/2011
RU 2007146701 A 6/2009
WO 02095775 A1 11/2002
WO WO02/095775 A1 * 11/2002 ..... H01F 7/06

(56) References Cited

FOREIGN PATENT DOCUMENTS

| | | | |
|---|---|---|---|
| WO | 2007078403 | A2 | 7/2007 |
| WO | 2009075110 | A1 | 6/2009 |
| WO | 2014130122 | A1 | 8/2014 |

OTHER PUBLICATIONS

European Patent Office; International Search Report and Written Opinion for International Application No. PCT/US2013/072789 dated May 27, 2014, 12 Pages.
International Bureau of WIPO; International Preliminary Report on Patentability for International Application No. PCT/US2013/072789 dated Aug. 25, 2015, 9 Pages.
Wilson, Earl J.; "Strain-Gage Instrumentation," Harris' Shock and Vibration Handbook, 2002, pp. 17.1-17.15, Chapter 17, 5th Edition.
Chee, Clinton Y.K., et al.; "A Review on the Modelling of Piezoelectric Sensors and Actuators Incorporated in Intelligent Structures," Journal of Intelligent Material Systems and Structures, 1998, pp. 3-19, vol. 9.
Simoes Moita, Jose M., et al.; "Active control of adaptive laminated structures with bonded piezoelectric sensors and actuators," Computers and Structures, 2004, pp. 1349-1358, vol. 82.
Fedder, Gary K., et al.; "Laminated High-Aspect-Ratio Microstructures in a Conventional CMOS Process," Proceedings of the IEEE Micro Electro Mechanical Systems Workshop, 1996, pp. 13-18.
European Patent Office; Extended European Search Report for European Patent Application No. 14178702.8 dated Jan. 21, 2015, 7 Pages.
European Patent Office; Extended European Search Report for European Patent Application No. 14179801.7 dated Jul. 10, 2015, 14 Pages.
European Patent Office; Extended European Search Report for European Patent Application No. 13173067.3 dated Nov. 3, 2015, 9 Pages.
Chinese Patent Office; Office Action for Chinese Patent Application No. 2013800736555 dated Aug. 26, 2016, 16 Pages.
Japanese Patent Office; Office Action for Japanese Patent Application No. 2013-149909 dated Jun. 6, 2017, 6 Pages.
European Patent Office; Extended European Search Report for European Patent Application No. 16195663.6 dated May 26, 2017, 9 Pages.
European Patent Office; Extended European Search Report for European Patent Application No. 16205134.6 dated May 29, 2017, 9 Pages.
Russian Patent Office; Office Action for Russian Patent Application No. 2013130327/07(045241) dated Jul. 18, 2017, 8 Pages.
Chinese Patent Office; Office Action for Chinese Patent Application No. 201310299638.5 dated Jul. 14, 2017, 33 Pages.
Chinese Patent Office; Office Action for Chinese Patent Application No. 201310299638.5 dated Dec. 18, 2017, 37 Pages.

* cited by examiner

MULTI-PULSE ELECTROMAGNETIC DEVICE INCLUDING A LINEAR MAGNETIC CORE CONFIGURATION

CROSS-REFERENCE TO RELATED APPLICATIONS

This application is related to U.S. patent application Ser. No. 12/824,291, filed Jun. 28, 2010, entitled "Augmented Power Converter," now U.S. Pat. No. 9,106,125 which is assigned to the same assignee as the present application.

This application is related to U.S. patent application Ser. No. 13/553,267, filed Jul. 19, 2012, entitled "Linear Electromagnetic Device," now U.S. Pat. No. 9,159,487 which is assigned to the same assignee as the present application.

This application is related to U.S. patent application Ser. No. 14/228,799, filed Mar. 28, 2014, entitled "Variable Core Electromagnetic Device," now U.S. Pat. No. 9,455,084 which is assigned to the same assignee as the present application.

FIELD

The present disclosure relates to electromagnetic devices, such as electrical power transformers, and more particularly to a multi-pulse electromagnetic device that includes a linear magnetic core configuration.

BACKGROUND

Transformer rectifier units (TRUs) and auto-transformer units (ATRUs) are electrical power transformer units that may be used on airplanes to convert 115 volts alternating current (VAC) at 400 Hertz to 28 volts direct current (VDC) airplane power for powering electrical systems and components on an airplane. The 115 VAC may be generated by one or more electrical power generator devices that are mechanically, operatively coupled to an airplane's engine by a drive shaft and gear arrangement to convert mechanical energy to electrical energy. The largest, heaviest and highest thermal emitting component in each TRU/ATRU is the transformer core. The weight of the TRUs/ATRUs and their thermal emissions can effect performance of the airplane. The weight of the TRUs/ATRUs is subtracted from the payload weight of the airplane and therefore reduces the amount of weight that the airplane may be designed to carry. Additionally, the cooling requirements may effect engine compartment design and thermal management.

SUMMARY

In accordance with an embodiment, an electromagnetic device may include an elongated core in which a magnetic flux in generable. The electromagnetic device may also include a first channel formed through the elongated core and a second channel formed through the elongated core. An inner core member is provided between the first channel and the second channel. The electromagnetic device may also include a primary winding wound around the inner core member and a plurality of secondary windings wound around the inner core member. An electric current flowing through the primary winding generates a magnetic field about the primary winding. The magnetic field is absorbed by the elongated core to generate the magnetic flux in the elongated core. The magnetic flux flowing in the elongated core causes an electric current to flow in each of the plurality of secondary windings.

In accordance with another embodiment, an electromagnetic device may include a first phase elongated core including a first channel, a second channel and a first phase inner core member provided between the first channel and the second channel. The electromagnetic device may also include a first phase primary winding wound around the first phase inner core member and a plurality of first phase secondary windings wound around the first phase inner core member. The electromagnetic device may additionally include a second phase elongated core including a first channel, a second channel and a second phase inner core member provided between the first channel and the second channel. A second phase primary winding may be wound around the second phase inner core member and a plurality of second phase secondary windings may be wound around the second phase inner core member. The electromagnetic device may further include a third phase elongated core including a first channel, a second channel and a third phase inner core member provided between the first channel and the second channel. A third phase primary winding may be wound around the third phase inner core member and a plurality of third phase secondary windings may be wound around the third phase inner core member.

In accordance with a further embodiment, a method for transforming electrical power may include providing an elongated core in which a magnetic flux in generable. The elongated core may include a first channel formed through the elongated core, a second channel formed through the elongated core, and an inner core member provided between the first channel and the second channel. The method may also include winding a primary winding around the inner core member and winding a plurality of secondary windings around the inner core member. An electric current flowing through the primary winding generates a magnetic field about the primary winding. The magnetic field is absorbed by the elongated core to generate the magnetic flux in the elongated core. The magnetic flux flowing in the elongated core causes an electric current to flow in each of the plurality of secondary windings.

In accordance with another embodiment or any of the previous embodiments, the elongated core may further include a first outer core member opposite one side of the inner core member and a second outer core member opposite another side the inner core member. The elongated core may also include a first side core member that connects a first end of the first outer core member to a first end of the inner core member and connects the first end of the inner core member to a first end of the second outer core member. The elongated core may additionally include a second side core member that connects a second end of the first outer core member to a second end of the inner core member and connects the second end of the inner core member to a second end of the second outer core member. A first magnetic circuit is formed about the first channel by the first outer core member, a first portion of the first side core member, the inner core member and a first portion of the second side core member. A second magnetic circuit is formed around the second channel by the inner core member, a second portion of the first side core member, the second outer core member and a second portion of the second side core member. The magnetic flux flows in the first magnetic circuit and the second magnetic circuit in response to the electric current flowing through the primary winding.

In accordance with another embodiment or any of the previous embodiments, the first channel and the second channel each include a depth dimension that corresponds to a longest dimension of the elongated core.

In accordance with another embodiment or any of the previous embodiments, the first channel and second channel each include a height dimension and a width dimension that forms an elongated opening transverse to the longest dimension of the elongated core.

In accordance with another embodiment or any of the previous embodiments, each turn of the primary winding and the plurality of second windings are adjacent to one another around the inner core member.

In accordance with another embodiment or any of the previous embodiments, the primary winding and each of the plurality of secondary windings are wound separately around the inner core member.

In accordance with another embodiment or any of the previous embodiments, the electromagnetic device includes a layer of electrical insulation material between the primary winding and each of the plurality of secondary windings and between each of the plurality of secondary windings.

In accordance with another embodiment or any of the previous embodiments, the elongated core includes one of a one-piece structure and a laminated structure including a plurality of plates stacked on one another.

BRIEF DESCRIPTION OF THE DRAWINGS

The following detailed description of embodiments refers to the accompanying drawings, which illustrate specific embodiments of the disclosure. Other embodiments having different structures and operations do not depart from the scope of the present disclosure.

DETAILED DESCRIPTION

Figure 1A:
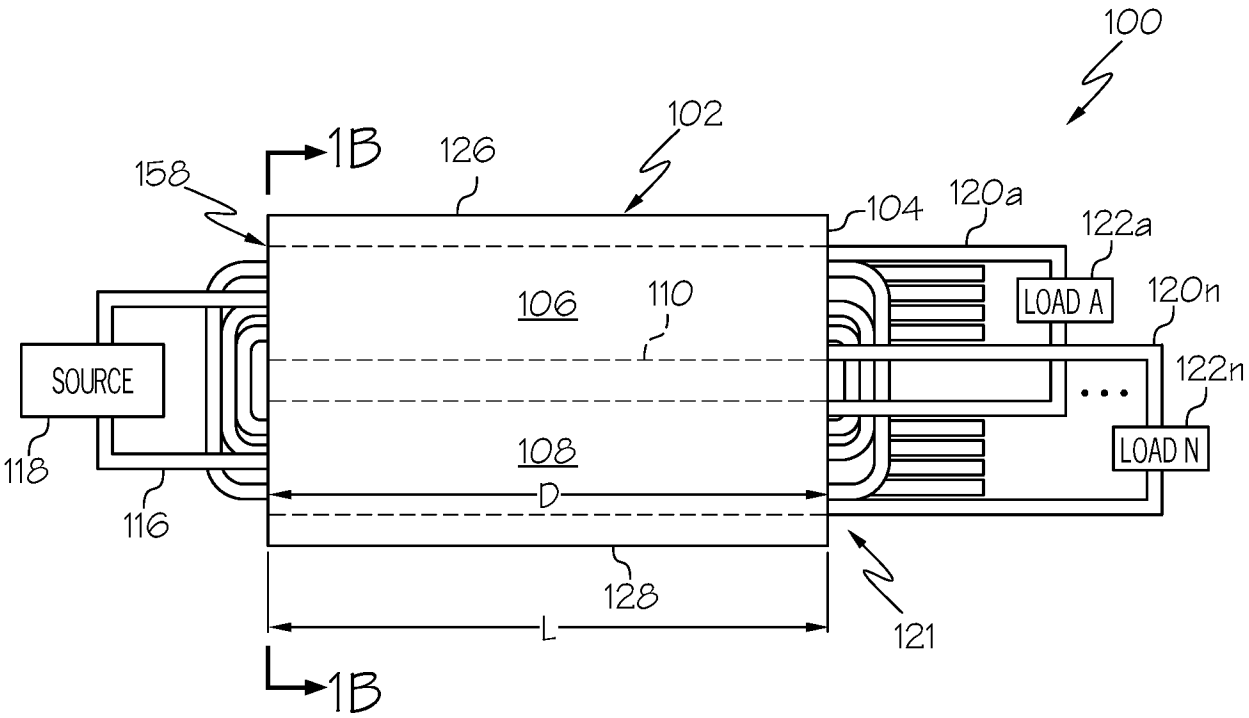
FIG. 1A is an illustration of an electric power distribution system including an exemplary electromagnetic device in accordance with an embodiment of the present disclosure.

The following detailed description of embodiments refers to the accompanying drawings, which illustrate specific embodiments of the disclosure. Other embodiments having different structures and operations do not depart from the scope of the present disclosure. Like reference numerals may refer to the same element or component in the different drawings.

Certain terminology is used herein for convenience only and is not to be taken as a limitation on the embodiments described. For example, words such as "proximal", "distal", "top", "bottom", "upper," "lower," "left," "right," "horizontal," "vertical," "upward," and "downward", etc., merely describe the configuration shown in the figures or relative positions used with reference to the orientation of the figures being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1B:
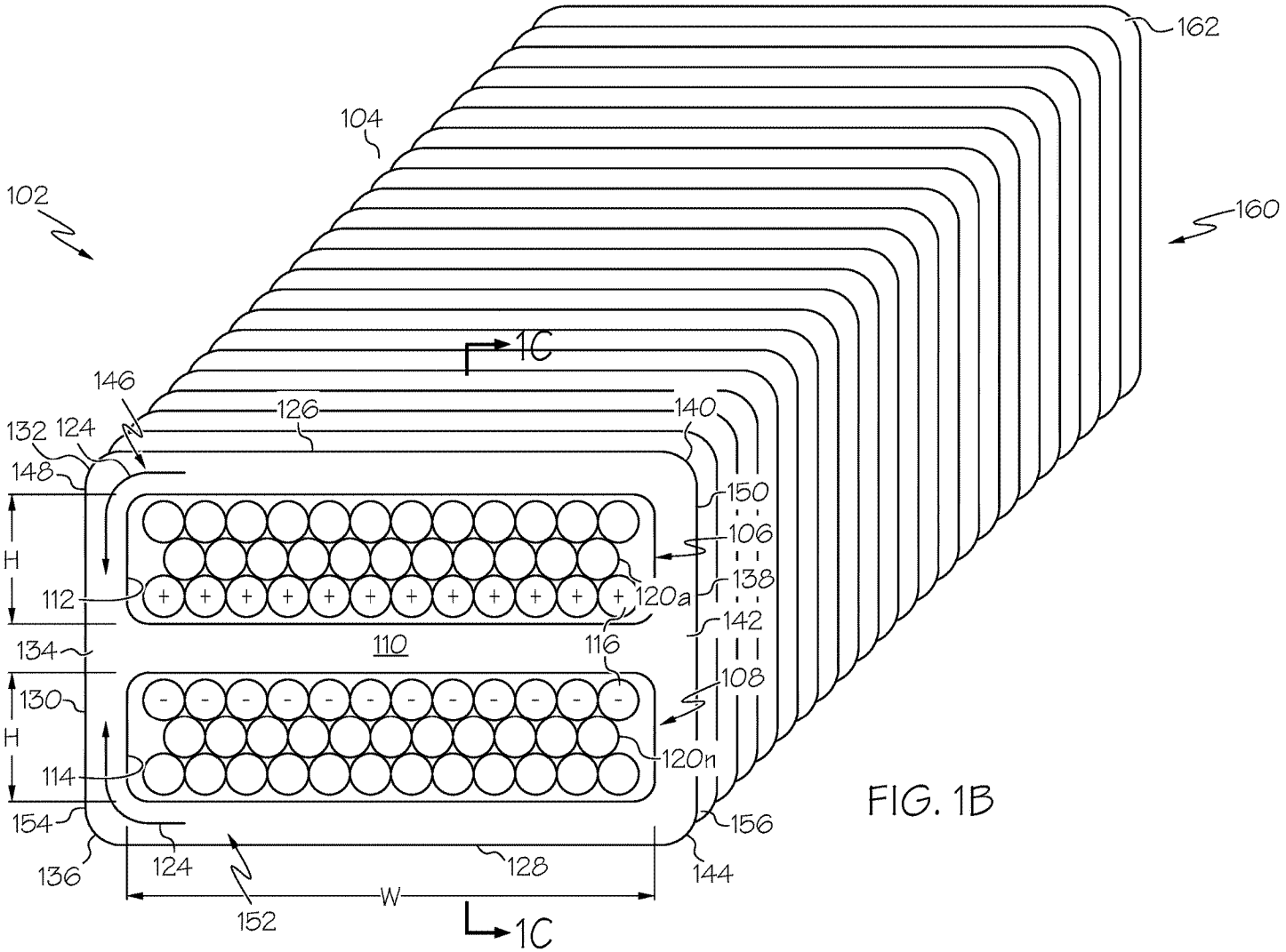
FIG. 1B is a perspective view of the exemplary electromagnetic device of FIG. 1A taken along lines 1B-1B in FIG. 1A.
Figure 1C:
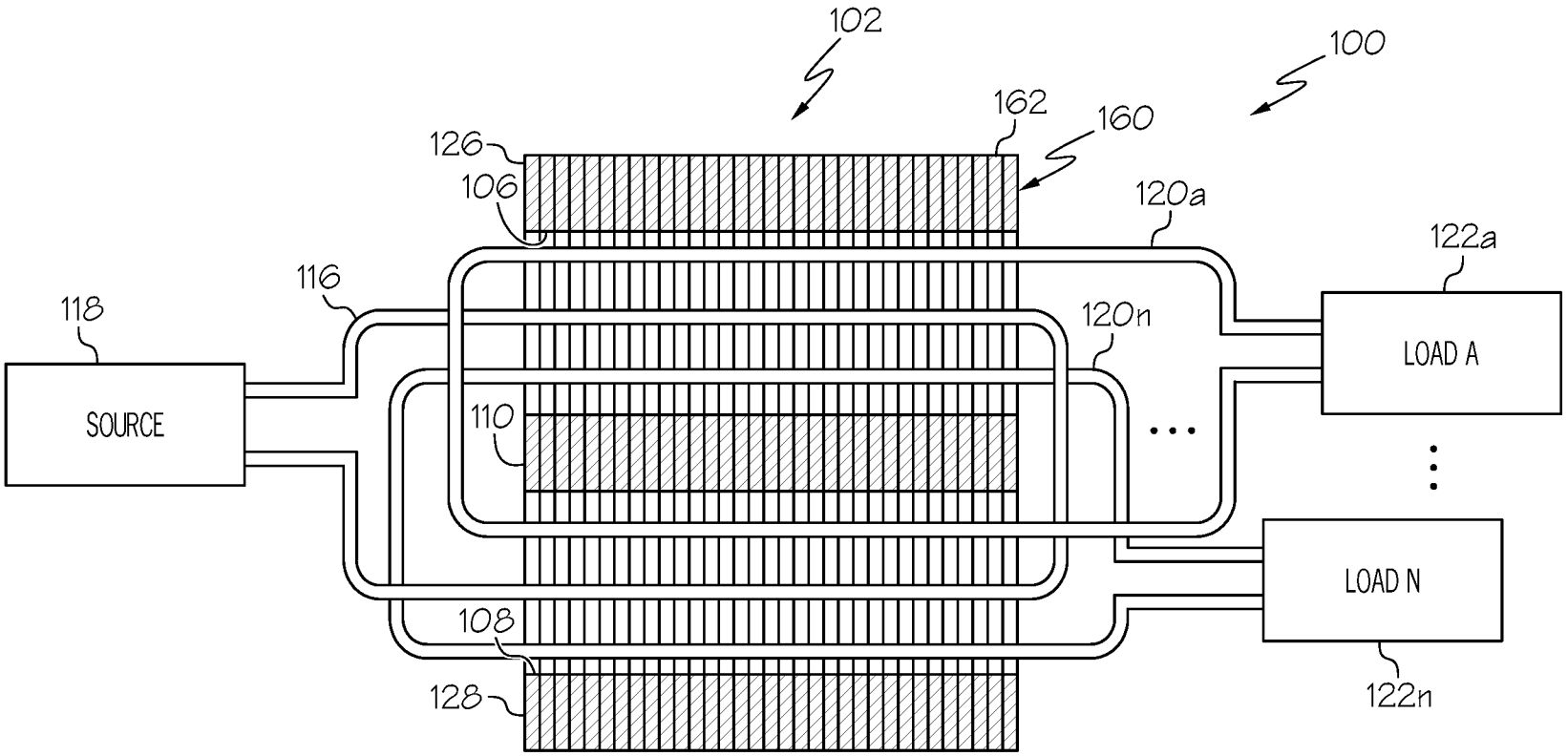
FIG. 1C is a cross-sectional view of the exemplary electromagnetic device of FIGS. 1A and 1B taken along lines 1C-1C in FIG. 1B.

FIG. 1A is an example of an electric power distribution system 100 including an exemplary electromagnetic device 102 in accordance with an embodiment of the present disclosure. The exemplary electromagnetic device 102 is configured as a multi-pulse electrical power transformer that includes an elongated core 104 in which a magnetic flux may be generated as described herein. The elongated core 104 includes a linear magnetic core configuration. Referring also to FIGS. 1B and 1C, FIG. 1B is a perspective view of the exemplary electromagnetic device 102 of FIG. 1A taken along lines 1B-1B in FIG. 1A. FIG. 1C is a cross-sectional view of the exemplary electromagnetic device 102 of FIGS. 1A and 1B taken along lines 1C-1C in FIG. 1B. The electromagnetic device 102 may include a first channel 106 formed through the elongated core 104 and a second channel 108 formed through the elongated core 104, both illustrated by the broken or dashed lines in FIG. 1A. An inner core member 110 may be provided or defined between the first channel 106 and the second channel 108. As illustrated in FIG. 1A, the first channel 106 and the second channel 108 may each include a depth dimension "D" that corresponds to a longest dimension "L" of the elongated core 104. Accordingly, the first channel 106 and the second channel 108 may both extend lengthwise through the elongated core 104. As best shown in FIG. 1B, the first channel 106 and the second channel 108 may each include a height dimension "H" and a width dimension "W" that forms or defines respectively a first elongated opening 112 or slot and a second elongated opening 114 or slot at each end of the elongated core 104. The first elongated opening 112 and second elongated opening 114 are transverse to the longest dimension "L" of the elongated core 104. In another embodiment, the height and width dimensions of the first channel 106 and the second channel 108 may be different from one another.

The electromagnetic device 102 may also include a primary winding 116 wound around the inner core member 110. The primary conductor winding may include an electrical conductor wire that is wound or wrapped a predetermined number of turns or wraps around the inner core member 110. The electrical conductor wire may be covered by a layer of insulation material. The primary winding 116 may be connected to a source of electrical power 118. For example, the source of electrical power 118 may be an electrical power generator device that is mechanically, operatively coupled to an engine of an airplane or other vehicle or to some other electrical power generating system.

The electromagnetic device 102 may also include a plurality of secondary windings 120*a*-120*n* that may also each be wound around the inner core member 110. Because the primary winding 116 and each of the secondary windings 120*a*-120*n* are wound around the inner core member 110, the electromagnetic device 102 may be referred to as including a linear magnetic core configuration 121. Each secondary winding 120*a*-120*n* may be an electrical conductor wire that is wound or wrapped a predetermined number of turns or wraps around the inner core member 110. The electrical conductor wire for each secondary winding 120*a*-120*n* may be covered by an electrical insulation material. If the electrical conductor wire for the primary winding 116 and each of the secondary windings 120*a*-120*n* are not covered by an electrical insulation material, then each of the windings needs to be separated by a layer of electrical insulation as described with reference to FIGS. 3A and 3B.

Each secondary winding 120*a*-120*n* may be respectively electrically connected to a load 122*a*-122*n*. Each load 122*a*-122*n* may be an electrical component or system of an airplane or other vehicle on which the electrical power distribution system 100 is installed. Each secondary winding 120*a*-120*n* and associated load 122*a*-122*n* are an independent electrical circuit. As is known in the art the output voltage at each respective secondary winding 120*a*-120*n* is proportional to the ratio of the number of turns of each respective secondary winding 120*a*-120*n* to the number of turns of the primary winding 116 multiplied by the input voltage across the primary winding 116 or the voltage supplied by the electrical power source 118.

An electric current (e.g. electrical current signal) flowing through the primary winding 116 generates a magnetic field about the primary winding 116. The magnetic field is absorbed by the elongated core 102 to generate a magnetic flux in the elongated core 104 as represented by arrows 124 in FIG. 1B. The magnetic flux 124 flowing in the elongated core 104 causes an electric current to flow in each of the plurality of secondary windings 120*a*-120*n*. The direction of flow of the magnetic flux 124 in the elongated core 104 is based on the direction of flow of electrical current in the primary winding 116 and using a convention known as the right-hand rule. For example, assuming an electrical current flowing through the primary winding 116 out of the page (+ sign on primary conductors in FIG. 1B) in the first channel 106 in FIG. 1B and into the page (− sign) through the primary winding 116 in the second channel 108, using the right-hand rule convention, the magnetic flux 124 would flow in a first direction indicated by the arrows transverse to an orientation of the primary winding 116 and each of the secondary windings 120*a*-120*n*. For an alternating current, the magnetic flux 124 will flow in the first direction indicated by the arrows in FIG. 1B for half the cycle of the alternating current, for example the positive half cycle, and in a second direction opposite the first direction for the other half cycle or negative half cycle of the alternating current. An alternating current is induced in the secondary windings 120*a*-120*n* as the magnetic flux 124 reaches a maximum amplitude each half cycle and collapses in correspondence with the alternating current flowing through the primary winding 116.

A linear length of the electrical conductor wire within the elongated core 104 of the primary winding 116 and each of the secondary windings 120*a*-120*n* corresponds to an efficiency of the electromagnetic device 102. The longer the linear length of the electrical conductor wire of the primary winding 116 within the elongated core 104, the greater the amount of the magnetic field around the wire is coupled into or absorbed by the elongated core 104 to generate the magnetic flux 124 flowing in response to an electrical current flowing the wire. Similarly, the longer the linear length of the electrical conductor wire of each secondary windings 120*a*-120*n* within the elongated core 104, the greater the coupling for generating electrical current in the secondary windings 120*a*-120*n* by the magnetic flux 124. Accordingly, the primary winding 116 and each of the secondary windings 120*a*-120*b* may each be wound around the inner core member 110 to maximize a linear length of the electrical conductor wire of each winding that is within the elongated core 104 for maximum efficiency of the electromagnetic device 102 in converting electrical power. Similarly, the longer the elongated core 104, the more efficient the electromagnetic device 102 in converting input electrical power to output electrical power.

In the exemplary embodiment illustrated in FIG. 1B, the primary winding 116 and the secondary windings 120*a*-120*n* are shown as being respectively wound separately around the inner core member 110 with the primary winding being wound first followed by each of the secondary windings 120*a*-120*n*. In other embodiments, the primary windings 116 and the secondary windings 120*a*-120*n* may be wound adjacent one another around the inner core member 110. Any winding arrangement may be used that provides efficient transformation of electrical power between the primary winding 116 and each of the secondary windings 120*a*-120*n* without adding weight to the electromagnetic device 102 or increasing thermal emissions from the electromagnetic device 102.

The elongated core 104 may also include a first outer core member 126 opposite one side of the inner core member 110 and a second outer core member 128 opposite another side the inner core member 110. A first side core member 130 connects a first end 132 of the first outer core member 126 to a first end 134 of the inner core member 110, and the first side core member 130 connects the first end 134 of the inner core member 110 to a first end 136 of the second outer core member 128. A second side core member 138 connects a second end 140 of the first outer core member 126 to a second end 142 of the inner core member 110. The second side core member 138 also connects the second end 142 of the inner core member 110 to a second end 144 of the second outer core member 128.

A first magnetic circuit 146 is formed about the first channel 106 by the first outer core member 126, a first portion 148 of the first side core member 130, the inner core member 110 and a first portion 150 of the second side core member 138. A second magnetic circuit 152 is formed around the second channel 108 by the inner core member 110, a second portion 154 of the first side core member 130, the second outer core member 128 and a second portion 156 of the second side core member 138. As previously described, the magnetic flux 124 flowing in the first magnetic circuit 146 and the second magnetic circuit 152 is in response to the electric current flowing through the primary winding 116.

In accordance with an embodiment, the elongated core 104 may include a one-piece structure 158 similar to that illustrated in FIG. 1A and may be formed from one piece of material or integrally formed from more than one piece of material. For example, the elongated core 104 may be a solid elongated core formed from a ferrite material, or a solid elongated core may define each channel 106 and 108 and the two elongated cores may be joined together.

In accordance with another embodiment, the elongated core 104 may include a laminated structure 160 formed by a plurality of plates 162 that are stacked on one another or adjacent one another as illustrated in FIGS. 1B and 1C. Each of the plates 162 may be made from a silicon steel alloy, a nickel-iron alloy or other metallic material capable of generating a magnetic flux similar to that described herein. For example, the elongated core 104 may be a nickel-iron alloy including about 20% by weight iron and about 80% by weight nickel. The plates 162 may be substantially square or rectangular, or may have some other geometric shape depending on the application of the electromagnetic device 102 and the environment where the electromagnetic device 102 may be located. For example, the substantially square or rectangular plates 162 may be defined as any type of polygon to fit a certain application or may have rounded corners, similar to that illustrated in FIG. 1B, so that the plates 162 are not exactly square or rectangular.

The first elongated opening 112 and second elongated opening 114 are formed through each of the plates 162. The openings 112 and 114 in each of the plates 162 are respectively aligned with one another to form the first channel 106 and the second channel 108 through the elongated core 104 when the plates 162 are stacked on one another or adjacent one another. The first and second channels 106 and 108 extend substantially perpendicular to a plane defined by each plate of the stack of plates 162 or laminates.

Figure 2:
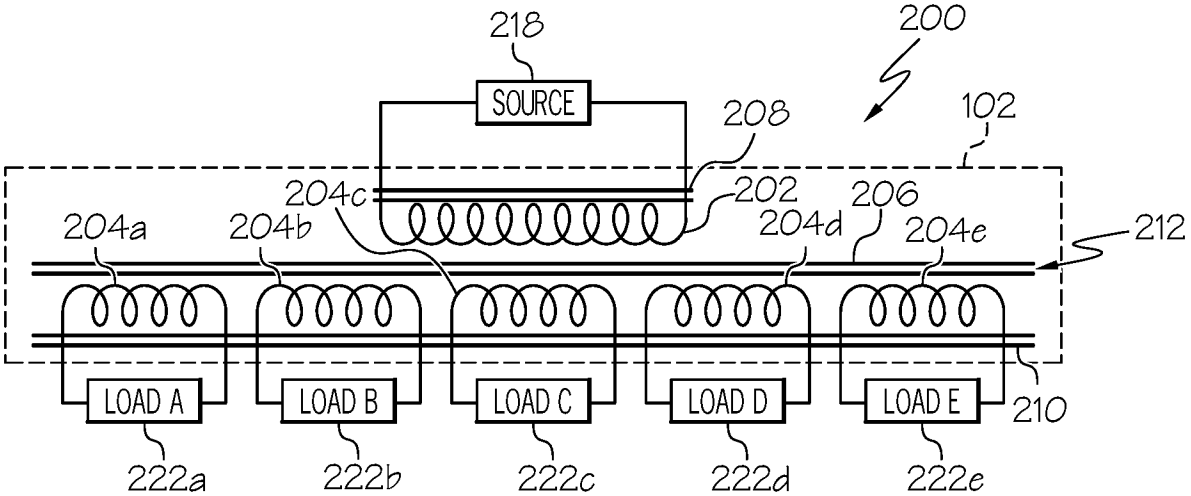
FIG. 2 is a schematic diagram of the exemplary electromagnetic device of FIGS. 1A-1C.

FIG. 2 is a schematic diagram of the exemplary electromagnetic device 102 of FIGS. 1A-1C. The exemplary electromagnetic device 102 illustrated in FIG. 2 is configured as a multi-pulse electrical transformer 200. The embodiment of the multi-pulse electrical transformer 200 illustrated in FIG. 2 includes a primary winding 202 and five secondary windings 204*a*-204*e*. Other embodiments of the electromagnetic device 102 or multi-pulse electrical transformer may include between two and five secondary windings. Other embodiments may include additional secondary windings. The primary winding 202 and the secondary windings 204*a*-204*e* are illustrated as being associated with or wound around an inner core member 206 as opposed to some of the windings being around the outer core members 208 and 210. As previously described, because the primary winding 202 and secondary windings 204*a*-204*e* are all wound around the inner core member 206, the multi-pulse electrical transformer 200 may be referred to as including a linear magnetic core configuration 212. An electrical power source 218 may be electrically connected to the primary winding 202 and each of the secondary windings 204*a*-204*e* may be electrically connected to a respective load 222*a*-222*e*. Each secondary winding 204*a*-204*e* and associated load 222*a*-222*e* define an independent electrical circuit.

Figure 3A:
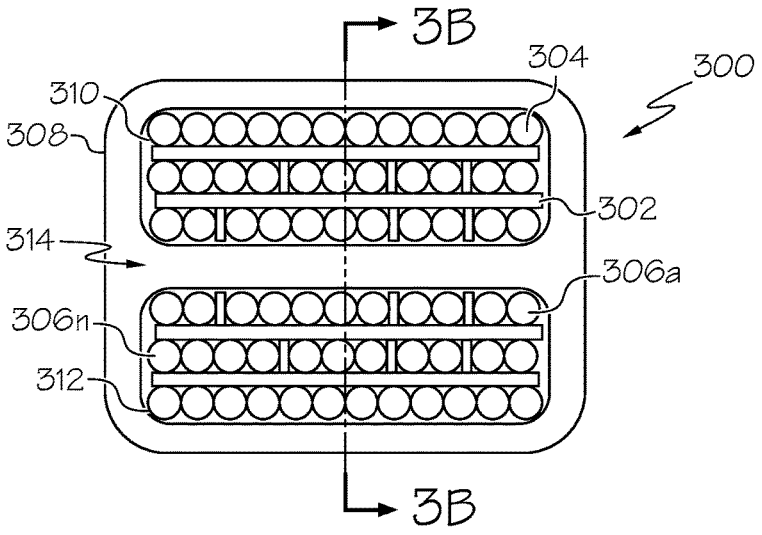
FIG. 3A is an end view of an exemplary electromagnetic device including a layer of electrical insulation material between the primary winding and each of the secondary windings and between each secondary winding in accordance with an embodiment of the present disclosure.
Figure 3B:
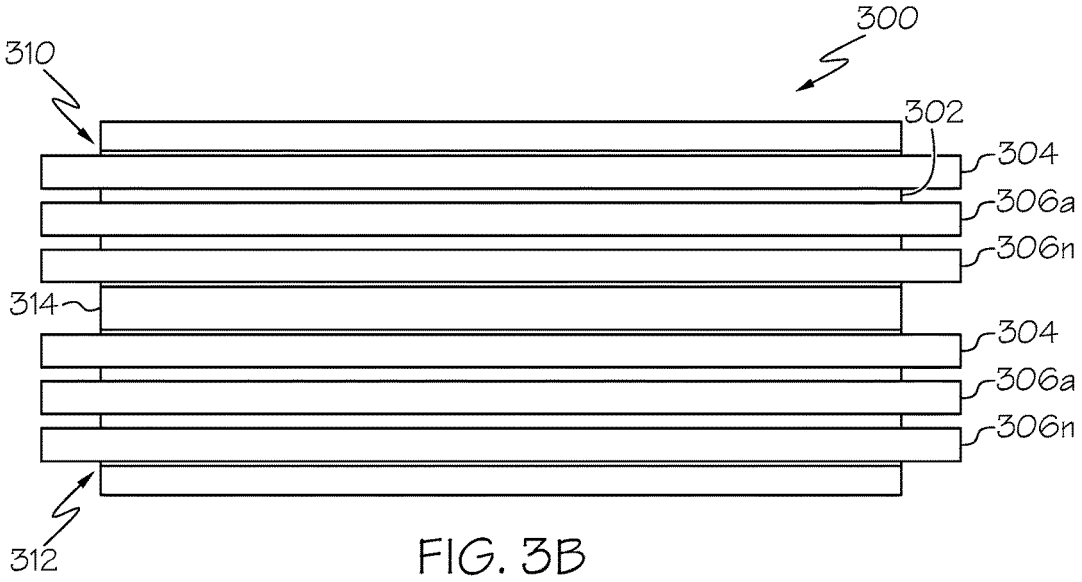
FIG. 3B is a cross-sectional view of the exemplary electromagnetic device of FIG. 3A taken along lines 3B-3B.

FIG. 3A is an end view of an exemplary electromagnetic device 300 including a layer of electrical insulation material 302 between the primary winding 304 and each of the secondary windings 306*a*-306*n* and between each secondary winding 306*a*-306*n* in accordance with an embodiment of the present disclosure. FIG. 3B is a cross-sectional view of the exemplary electromagnetic device of FIG. 3A taken along lines 3B-3B. Accordingly, the primary winding 304 and each of the secondary windings 306*a*-306*n* are separated from one another by a layer of electrical insulation material 302. The electromagnetic device 300 may include an elongated core 308 similar to the elongated core 104 in FIGS. 1A-1C. Accordingly, electromagnetic device 300 may include a first channel 310 and second channel 312 through the elongated core 308. An inner core member 314 may be provided or may be defined by the first channel 310 and the second channel 312. The electromagnetic device 300 may be used for the electromagnetic device 102 in FIGS. 1A-1C.

Figure 4:
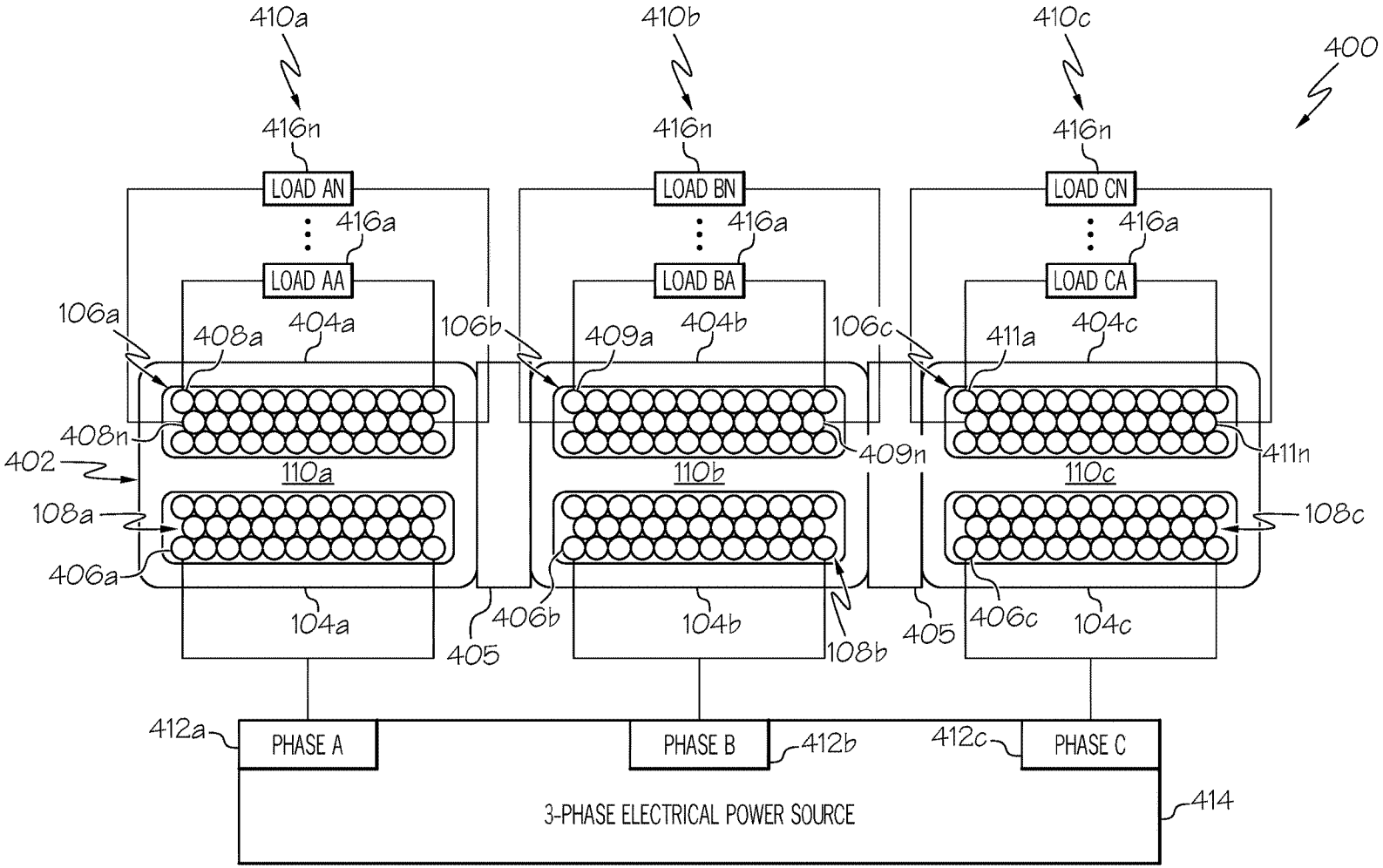
FIG. 4 is an example of a three-phase power distribution system including a three-phase electromagnetic apparatus or device in accordance with an embodiment of the present disclosure.

FIG. 4 is an example of a three-phase power distribution system 400 including a three-phase electromagnetic apparatus 402 or device in accordance with an embodiment of the present disclosure. The three-phase electromagnetic apparatus 402 may include a single phase electromagnetic device 404*a*-404*c* for each phase of a three-phase power distribution system 400. Each single phase electromagnetic device 404*a*-404*c* may be the same or similar to the electromagnetic device 102 described with reference to FIGS. 1A-1C. Each of the electromagnetic devices 404*a*-404*c* may be configured as a multi-pulse transformer including a linear magnetic core as described above.

The electromagnetic devices 404*a*-404*c* may abut directly against one another, or a spacer 405 similar to that illustrated in the exemplary embodiment in FIG. 4 may be disposed between adjacent electromagnetic devices 404*a*-404*c*. The spacer 405 may be made from an insulation material, a non-ferrous material or other material that will not adversely affect efficient operation of the three-phase electromagnetic apparatus 402. Additionally, while the electromagnetic devices 404*a*-404*c* are shown as being placed side-by-side in the exemplary embodiment in FIG. 4, other arrangements of the electromagnetic devices 404*a*-404*c* may also be utilized depending upon the application or environment where the three-phase electromagnetic apparatus 402 may be deployed. For example, in another embodiment, the electromagnetic devices 404*a*-404*c* may be vertically stacked on one another, or in a further embodiment, one electromagnetic device 404*a* may be stacked on two other electromagnetic devices 404*b*-404*c* that are positioned adjacent one another similar to that shown in FIG. 4.

A first phase 410*a* or phase A electromagnetic device 404*a* of the three-phase electromagnetic apparatus 402 may include a first phase elongated core 104*a* including a first channel 106*a*, a second channel 108*a* and a first phase inner core member 110*a* provided between the first channel 106*a* and the second channel 108*a*. A first phase primary winding 406*a* may be wound around the first phase inner core member 110*a*. A plurality of first phase secondary windings 408*a*-408*n* may also wound around the first phase inner core member 110*a*.

A second phase 410*b* or phase B electromagnetic device 404*b* of the three-phase electromagnetic apparatus 402 may include a second phase elongated core 104*b* including a first channel 106*b*, a second channel 108*b* and a second phase inner core member 110*b* provided between the first channel 106*b* and the second channel 108*b*. A second phase primary winding 406*b* may be wound around the second phase inner core member 110*b*. A plurality of second phase secondary windings 409*a*-409*n* may also be wound around the second phase inner core member 110*b*.

A third phase 410*c* or phase C electromagnetic device 404*c* may include a third phase elongated core 104*c* including a first channel 106*c*, a second channel 108*c* and a third phase inner core member 110*c* provided between the first channel 106*c* and the second channel 108*c*. A third phase primary winding 406*c* may be wound around the third phase inner core member 110*c*. A plurality of third phase secondary windings 411*a*-411*n* may also be wound around the third phase inner core member 110*c*.

Each electromagnetic device 404*a*-404*c* provides or defines a phase, phase A 410*a*, phase B 410*b*, and phase C 410*c* of the three-phase power distribution system 400. The primary winding 406*a*-406*c* of each electromagnetic device 404*a*-404*c* may be respectively electrically connected to one phase, phase A 412*a*, phase B 412*b* or phase C 412*c*, of a three-phase electrical power source 414. Each secondary winding 408*a*-408*n*, 409*a*-409*n*, 411*a*-411*n* of each electromagnetic device 404*a*-404*c* or phase may be respectively electrically connected to a different load 416*a*-416*n* of each phase 410*a*-410*b*. Each of the electromagnetic devices 404*a*-404*c* may operate similar to electromagnetic device 102 described with respect to FIGS. 1A-1C to transform three-phase electrical power from the three-phase electrical power source 414 to supply appropriate electrical power to each of the loads 416*a*-416*n* of each phase 410*a*-410*c*. A magnetic flux may be generated in any of the elongated cores 104*a*-104*c* in response to an alternating electrical current flowing in an associated primary winding primary winding 406*a*-406*c*.

Figure 5:
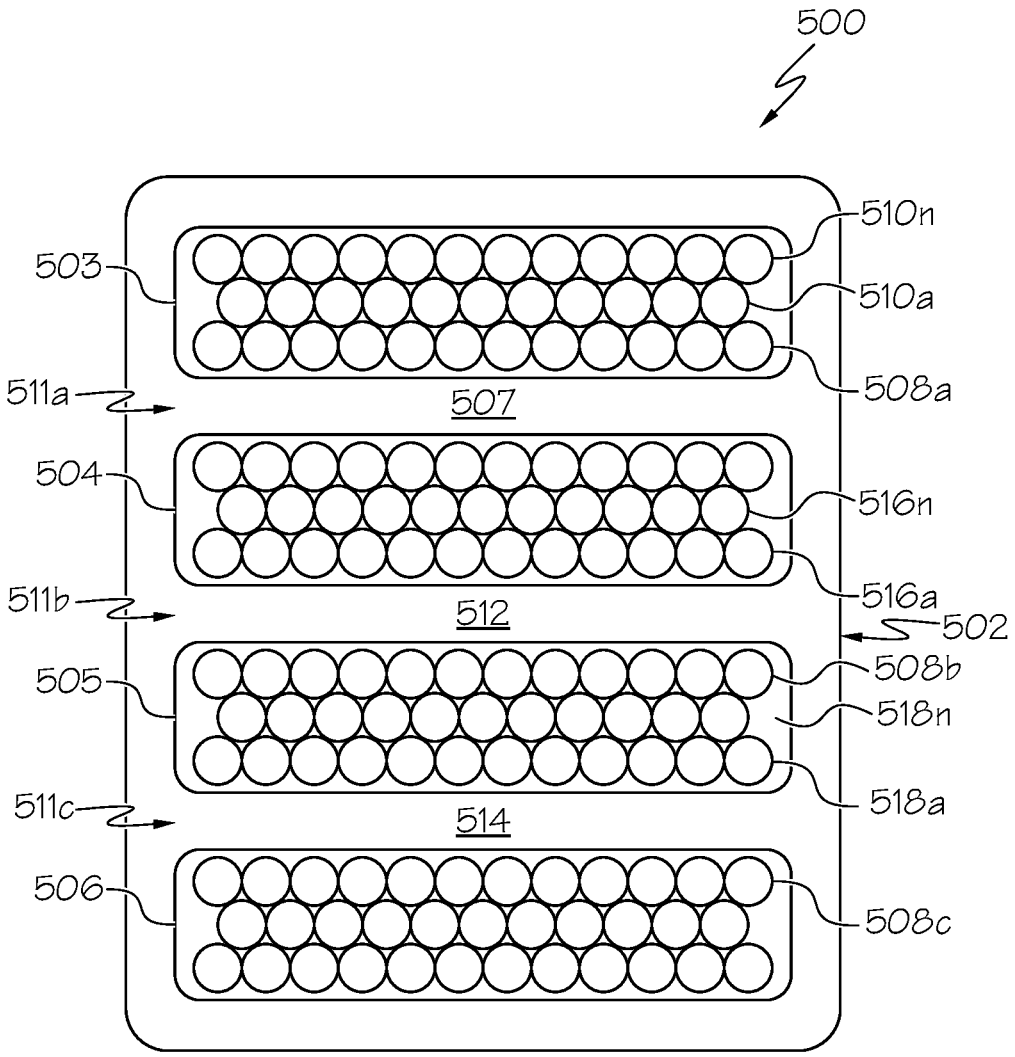
FIG. 5 is an end view of an exemplary three-phase electromagnetic device in accordance with another embodiment of the present disclosure.

FIG. 5 is an end view of an exemplary three-phase electromagnetic device 500 in accordance with another embodiment of the present disclosure. The three-phase electromagnetic device 500 may be used in a three-phase power distribution system similar to the system 400 in FIG. 4. The three-phase electromagnetic device 500 may be used in place of the three-phase electromagnetic apparatus 402 or device in FIG. 4. The three-phase electromagnetic device 500 may be similar to the electromagnetic device 102 described with reference to FIGS. 1A-1C and may include an elongated core 502 that may be similar to the elongated core 104 except that in addition to a first channel 503 and a second channel 504 through the elongated core 502, the electromagnetic device 500 also includes a third channel 505 and a fourth channel 506 through the elongated core 502. The first channel 503 and the second channel 504 provide an inner core member 507 similar to the inner core member 110 of electromagnetic device 102 in FIGS. 1A-1C. A primary winding 508*a* and a plurality of secondary windings 510*a*-510*n* wound around the inner core member 507 may form a first phase 511*a* of the three-phase electromagnetic device 500.

A second inner core member 512 may be provided or defined between the second channel 504 and the third channel 505 and a third inner core member 514 may be provided or defined between the third channel 505 and the fourth channel 506. A second phase primary winding 508*b* and a plurality of second phase secondary windings 516*a*-516*n* may be wound around the second inner core member 512. The second phase primary winding 508*b* and the plurality of second phase secondary windings 516*a*-516*n* wound around the second inner core member 512 form a second phase 511*b* of the three-phase electromagnetic device 500. The second phase primary winding 508*b* may be electrically connected to a second phase or phase B of a three-phase electrical power source, such as three-phase electrical power source 414 in FIG. 4. The second phase secondary windings 516*a*-516*n* may each be electrically connected to a respective load, such as second phase loads 416*a*-416*n* in FIG. 4.

A third phase primary winding 508*c* and a plurality of third phase secondary windings 518*a*-518*n* may also be wound around the third inner core member 514. The third phase primary winding 508*c* and the plurality of third phase secondary windings 518*a*-518*n* wound around the third inner core member 514 may form a third phase 511*c* of the three-phase electromagnetic device 500. The third phase primary winding 508*c* may be electrically connected to a third phase or phase C of a three-phase electrical power source, such as three-phase electrical power source 414 in FIG. 4. The third phase secondary windings 518*a*-518*n* may each be electrically connected to a respective load, such as third phase loads 416*a*-416*n* in FIG. 4.

Figure 6:
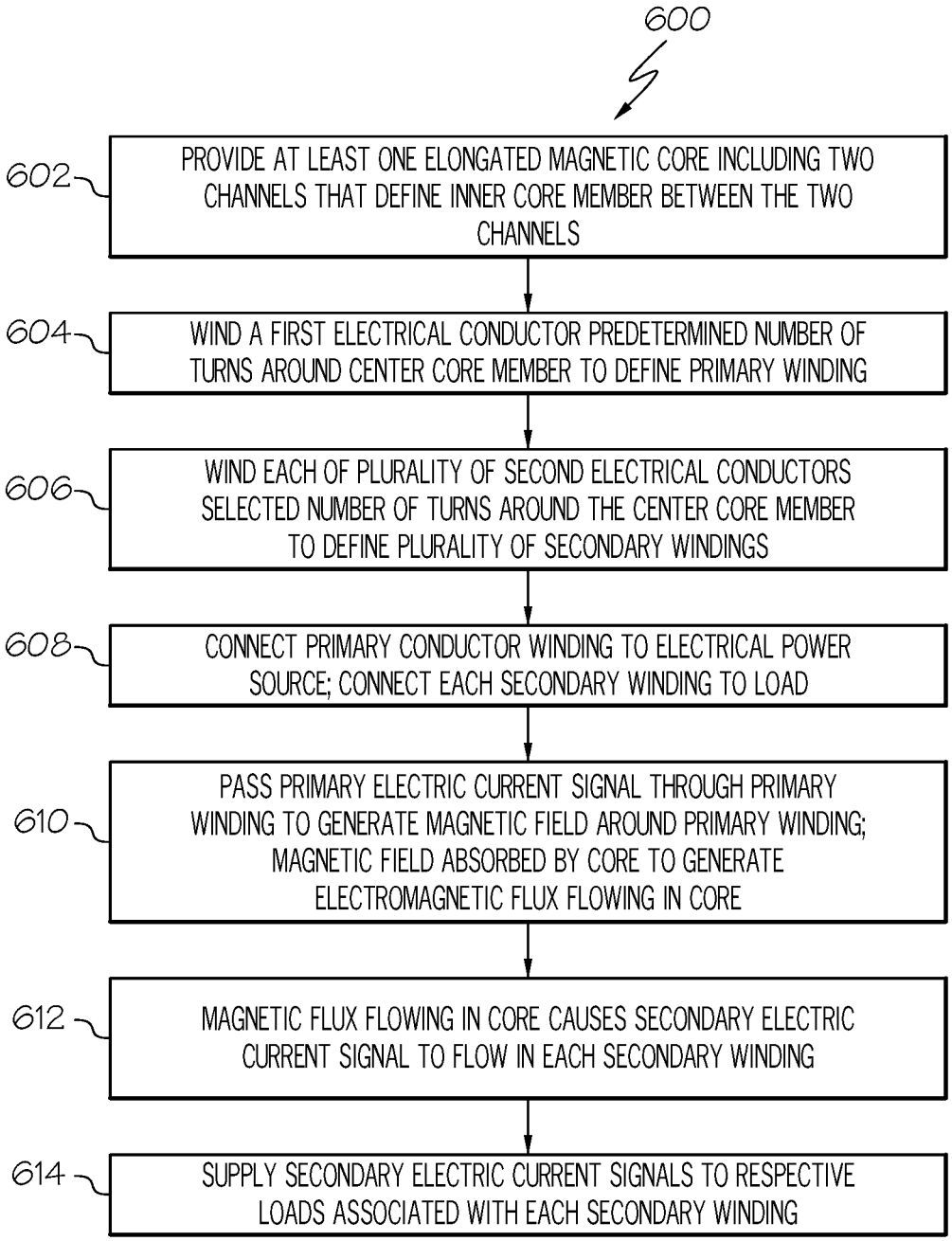
FIG. 6 is a flow chart of an example of a method for transforming an electric signal into multiple output pulses in accordance with an embodiment of the present disclosure.

FIG. 6 is a flow chart of an example of a method 600 for transforming an electric signal into multiple output pulses in accordance with an embodiment of the present disclosure. In block 602, at least one elongated core or elongated magnetic core may be provided in which a magnetic flux may be generated. The elongated core may include a first channel and a second channel formed through the elongated core. An inner core member may be provided or defined between the first channel and the second channel. The first channel and the second channel may each include a depth dimension that corresponds to a longest dimension of the elongated core.

The elongated core may also include a first outer core member opposite one side of the inner core member and a second outer core member opposite another side the inner core member. A first side core member may connect a first end of the first outer core member to a first end of the inner core member and may connect the first end of the inner core member to a first end of the second outer core member.

A second side core member may connect a second end of the first outer core member to a second end of the inner core member and may connect the second end of the inner core member to a second end of the second outer core member. A first magnetic circuit is formed about the first channel by the first outer core member, a first portion of the first side core member, the inner core member and a first portion of the second side core member. A second magnetic circuit is formed around the second channel by the inner core member, a second portion of the first side core member, the second outer core member and a second portion of the second side core member. The magnetic flux flows in the first magnetic circuit and the second magnetic circuit in response to the electric current flowing through the primary winding.

In block 604, a first electrical conductor may be wound a predetermined number of turns around the inner core member to define a primary winding. In block 606, a plurality of second electrical conductors may each be wound a selected number of turns around the inner core member to define a plurality of secondary windings. An electric current flowing through the primary winding generates a magnetic field about the primary winding and the magnetic field is absorbed by the elongated core to generate the magnetic flux in the elongated core. The magnetic flux flowing in the elongated core causes an electric current to flow in each of the plurality of secondary windings.

In block 608, the primary winding may be connected to an electrical power source and each of the secondary windings may be connected to a load. In block 610, an electrical current signal may be passed through the primary winding to generate a magnetic field around the primary winding. The magnetic field may be absorbed by the elongated core to generate an electromagnetic flux flowing in the elongated core.

In block 612, the magnetic flux flowing in the elongated core may cause a secondary electric current signal to flow in each secondary winding. In block 614, the secondary electric current signals may be supplied to the respective loads associated with each secondary winding.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to embodiments of the invention in the form disclosed. Many modifications and variations will be apparent to those of ordinary skill in the art without departing from the scope and spirit of embodiments of the invention. The embodiment was chosen and described in order to best explain the principles of embodiments of the invention and the practical application, and to enable others of ordinary skill in the art to understand embodiments of the invention for various embodiments with various modifications as are suited to the particular use contemplated.

Although specific embodiments have been illustrated and described herein, those of ordinary skill in the art appreciate that any arrangement which is calculated to achieve the same purpose may be substituted for the specific embodiments shown and that embodiments of the invention have other applications in other environments. This application is intended to cover any adaptations or variations of the present invention. The following claims are in no way intended to limit the scope of embodiments of the invention to the specific embodiments described herein.

What is claimed is:

1. An electromagnetic device (102), comprising:

a single elongated core (104) in which a magnetic flux (124) is generable;

a first channel (106) formed through the elongated core;

a second channel (108) formed through the elongated core, wherein the elongated core has only the first channel and the second channel extending lengthwise therein;

an inner core member (110) provided between the first channel and the second channel, wherein the first channel and the second channel are spaced from one another to define a common flux flow area in the inner core member;

a primary winding (116) wound around the inner core member; and a plurality of secondary windings (120*a*-120*n*) wound only around the inner core member of the single core, wherein an electric current flowing through the primary winding generates a magnetic field about the primary winding and the magnetic field is absorbed by the elongated core to generate the magnetic flux in the elongated core, the magnetic flux flowing in the elongated core causes an electric current to flow in each of the plurality of secondary windings, wherein each of the plurality of secondary windings is configured to connect to a different load.

2. The electromagnetic device of claim 1, wherein the elongated core further comprises:

a first outer core member (126) opposite one side of the inner core member;

a second outer core member (128) opposite another side the inner core member;

a first side core member (130) that connects a first end (132) of the first outer core member to a first end (134) of the inner core member and connects the first end of the inner core member to a first end (136) of the second outer core member; and a second side core member (138) that connects a second end (140) of the first outer core member to a second end (142) of the inner core member and connects the second end of the inner core member to a second end (144) of the second outer core member, wherein a first magnetic circuit (146) is formed about the first channel by the first outer core member, a first portion (148) of the first side core member, the inner core member and a first portion (150) of the second side core member, and wherein a second magnetic circuit (152) is formed around the second channel by the inner core member, a second portion (154) of the first side core member, the second outer core member and a second portion (156) of the second side core member, the magnetic flux flowing in the first magnetic circuit and the second magnetic circuit in response to the electric current flowing through the primary winding.

3. The electromagnetic device of claim 1, wherein the first channel and the second channel each include a depth dimension (D) that corresponds to a longest dimension (L) of the elongated core.

4. The electromagnetic device of claim 3, wherein the first channel and the second channel each comprise a height dimension and a width dimension (W) that forms an elongated opening transverse to the longest dimension of the elongated core.

5. The electromagnetic device of claim 1, wherein each turn of the primary winding and the plurality of secondary windings are adjacent to one another around the inner core member.

6. The electromagnetic device of claim 1, wherein the primary winding and each of the plurality of secondary windings are wound separately around the inner core member.

7. The electromagnetic device of claim 1, wherein the primary winding and each of the plurality of secondary windings are each wound around the inner core member to maximize a linear length of each winding within the elongated core.

8. The electromagnetic device of claim 1, further comprising a layer of electrical insulation material (302) between the primary winding and each of the plurality of secondary windings and between each of the plurality of secondary windings.

9. The electromagnetic device of claim 1, wherein the elongated core comprises one of a one-piece structure (158) and a laminated structure (160) including a plurality of plates (162) stacked on one another.

10. The electromagnetic device of claim 1, wherein the magnetic flux is generated by an alternating current flowing in the primary winding, the magnetic flux flows in a first direction transverse to an orientation of the primary winding and plurality of secondary windings during a positive half cycle of the alternating current and in a second direction opposite to the first direction during a negative half cycle of the alternating current.

11. The electromagnetic device of claim 1, wherein the plurality of secondary windings comprises between two and five secondary windings.

12. The electromagnetic device of claim 1, wherein the primary winding and the plurality of secondary windings wound around the inner core member form a first phase (410*a*) of a three-phase electromagnetic device (500.

13. The electromagnetic device of claim 1, wherein each of the plurality of secondary windings comprise a different number of turns.

14. The electromagnetic device of claim 1, wherein the primary winding is configured to connect to an electric power generator device that is operatively coupled to an engine of an airplane or other vehicle.

15. The electromagnetic device of claim 1, wherein each different load is an electrical component or system of an airplane or other vehicle.

16. An electromagnetic device (102), comprising:

a single elongated core (104) in which a magnetic flux (124) is generable;

a first channel (106) formed through the elongated core;

a second channel (108) formed through the elongated core, wherein the elongated core has only the first channel and the second channel extending lengthwise therein;

an inner core member (110) provided between the first channel and the second channel;

a primary winding (116) wound around the inner core member; and a plurality of secondary windings (120*a*-120*n*) wound only around the inner core member of the single core, wherein an electric current flowing through the primary winding generates a magnetic field about the primary winding and the magnetic field is absorbed by the elongated core to generate the magnetic flux in the elongated core, the magnetic flux flowing in the elongated core causes an electric current to flow in each of the plurality of secondary windings, wherein each of the plurality of secondary windings is configured to connect to a different load, wherein the primary winding and the plurality of secondary windings wound around the inner core member form a first phase (511*a*) of a three-phase electromagnetic device, the three-phase electromagnetic device comprising:

a second phase (410*b*), the second phase comprising:

a second phase elongated core (104*b*) in which a magnetic flux is generable a first channel (106*b*) formed through the second phase elongated core;

a second channel (108*b*) formed through the second phase elongated core;

a second phase inner core member (110*b*) provided between the first channel and the second channel;

a second phase primary winding (406*b*) wound around the second phase inner core member;

a plurality of second phase secondary windings (409*a*-409*n*) wound around the second phase inner core member, the second phase primary winding and the plurality of second phase secondary windings wound around the second phase inner core member form a second phase (511*b*) of the three-phase electromagnetic device, wherein each of the plurality of second phase secondary windings is configured to connect to a different load;

a third phase (410*c*), the third phase comprising:

a third phase elongated core (104*c*) in which a magnetic flux is generable;

a first channel (106*c*) formed through the third phase elongated core;

a second channel (108*c*) formed through the third phase elongated core;

a third phase inner core member (110*c*) provided between the first channel and the second channel;

a third phase primary winding (406*c*) wound around the third phase inner core member; and a plurality of third phase secondary windings (411*a*-411*n*) wound around the third phase inner core member, the third phase primary winding and the plurality of third phase secondary windings wound around the third phase inner core member form a third phase (511*c*) of the three-phase electromagnetic device, wherein each of the plurality of third phase secondary windings is configured to connect to a different load.

17. An electromagnetic device (402), comprising:

a first phase elongated core (104*a*) including a first channel (106*a*), a second channel (108*a*) and a first phase inner core member (110*a*) provided between the first channel and the second channel;

a first phase primary winding (406*a*) wound around the first phase inner core member, the first phase primary winding being connectable to a first phase (412A) of a three phase electrical power supply (414);

a plurality of first phase secondary windings (408*a*-408*n*) wound around the first phase inner core member, wherein each of the plurality of first phase secondary windings is configured to connect to a different load;

a second phase elongated core (104*b*) including a first channel (106*b*), a second channel (108*b*) and a second phase inner core member (110*b*) provided between the first channel and the second channel;

a second phase primary winding (406*b*) wound around the second phase inner core member, the second phase primary winding being connectable to a second phase (412*b*) of the three phase electrical power supply (414);

a plurality of second phase secondary windings (409*a*-409*n*) wound around the second phase inner core member, wherein each of the plurality of second phase secondary windings is configured to connect to a different load;

a third phase elongated core (104*c*) including a first channel (106*c*), a second channel (108*c*) and a third phase inner core member (110*c*) provided between the first channel and the second channel;

a third phase primary winding (406*c*) wound around the third phase inner core member, the third phase primary winding being connectable to a third phase (412*c*) of the three phase electrical power supply (414); and a plurality of third phase secondary windings (411*a*-411*n*) wound around the third phase inner core member, wherein each of the plurality of third phase secondary windings is configured to connect to a different load; and wherein each elongated core comprises one of a one-piece structure (158) and a laminated structure (160) comprising a plurality of plates (162) stacked on one another.

18. The electromagnetic device of claim 17, wherein each elongated core comprises:

a first outer core member (126) opposite one side of the inner core member;

a second outer core member (128) opposite another side the inner core member;

a first side core member (130) that connects a first end (132) of the first outer core member to a first end (134) of the inner core member and connects the first end of the inner core member to a first end (136) of the second outer core member; and a second side core member (138) that connects a second end (140) of the first outer core member to a second end (142) of the inner core member and connects the second end of the inner core member to a second end (144) of the second outer core member, wherein a first magnetic circuit (146) is formed about the first channel by the first outer core member, a first portion (148) of the first side core member, the inner core member and a first portion (150) of the second side core member, and wherein a second magnetic circuit (152) is formed around the second channel by the inner core member, a second portion (154) of the first side core member, the second outer core member and a second portion (156) of the second side core member, wherein magnetic flux flows in the first magnetic circuit and the second magnetic circuit of a particular phase elongated core in response to an electric current flowing through the primary winding of the particular phase elongated core.

19. The electromagnetic device of claim 17, wherein a magnetic flux is generated in any of the elongated cores in response an alternating current flowing in an associated primary winding, the magnetic flux flowing in a first direction transverse to an orientation of the associated primary winding and plurality of secondary windings during a positive half cycle of the alternating current and in a second direction opposite to the first direction during a negative half cycle of the alternating current.

* * * * *